US006308538B1

(12) United States Patent
Wood et al.

(10) Patent No.: US 6,308,538 B1
(45) Date of Patent: Oct. 30, 2001

(54) METHOD AND APPARATUS FOR MANUFACTURING INDIVIDUAL WIPERS HAVING FINISHED EDGES

(75) Inventors: William T. Wood, South Egremenont; Bradley L. Forbes, Housatonic; Peter S. Simmons, Jr., Lee; Christopher J. Fountain, Housatonic, all of MA (US); John O'Connell, Averill Park; Richard H. Romer, Nassau, both of NY (US)

(73) Assignee: Berkshire Corporation, Great Barrington, MA (US)

( * ) Notice: Subject to any disclaimer, the term of this patent is extended or adjusted under 35 U.S.C. 154(b) by 0 days.

(21) Appl. No.: 09/359,106

(22) Filed: Jul. 22, 1999

(51) Int. Cl.[7] ..... D04B 7/28
(52) U.S. Cl. ..... 66/170; 66/202; 66/169 R
(58) Field of Search ..... 66/169 R, 170, 66/171, 172 R, 194, 195, 196, 202; 442/304, 312; 428/43; 15/208, 209.1

(56) References Cited

U.S. PATENT DOCUMENTS 2,263,787 * 11/1941 Safferson ..... 66/170
3,331,221 * 7/1967 Lawson ..... 66/170
3,470,928 * 10/1969 Schwartz ..... 66/202
5,069,735 * 12/1991 Reynolds ..... 66/170
5,520,022 * 5/1996 Callaway ..... 66/170
5,594,970 * 1/1997 Benge ..... 66/170
5,605,731 * 2/1997 Guasch Pubill ..... 66/170
5,667,612 * 9/1997 Benge ..... 66/170

* cited by examiner

*Primary Examiner*—Danny Worrell
(74) *Attorney, Agent, or Firm*—McCormick Paulding & Huber LLP

(57) ABSTRACT

A knitted web and a method for making the same includes a plurality of wipers, each having a wiper body with a length defined between finished leading and trailing edges and a width defined between opposed, selvaged side edges. The wipers are knitted with continuous yarns, including a primary yarn and a reinforcing yarn, and a separable portion is knitted between individual wipers using a dissociable yarn. Loose primary and reinforcing yarns extending between wipers are cut and the dissociable yarn is removed from between the wipers to separate the web into individual wipers with edges that require no edge treatment to prevent raveling.

23 Claims, 11 Drawing Sheets

95

| 88 HIGH BUTT | 86 LOW BUTT | 94 Needle raising cam / 92 Center cam |
|---|---|---|
| 0 | 0 | (Continuation of the previous course condition) |
| MISS | MISS | |
| TUCK | MISS | Half |
| KNIT | MISS | Half / Half |
| TUCK | TUCK | Full |
| KNIT | TUCK | Full / Half |
| KNIT | KNIT | Full / Full |

96

FIG. 17

METHOD AND APPARATUS FOR MANUFACTURING INDIVIDUAL WIPERS HAVING FINISHED EDGES

BACKGROUND OF THE INVENTION

Technical Field

The present invention relates generally to special purpose wipers and, more particularly, to a plurality of flat wipers and method of making the same by a continuous knitting operation which periodically incorporates a dissolvable yarn that, when wetted, dissolves and leaves a plurality of individual wipers.

BACKGROUND OF THE INVENTION

Special purpose wipers are known in the art for use in controlled environment facilities such as cleanrooms that require the maintenance of an extremely clean environment. The wipers are typically used to clean and prepare surfaces while at the same time avoiding contamination of the environment by particulates or lint from the wiper. Critical environments can be found in hospitals and medical facilities, the pharmaceutical, aircraft and automotive industries, as well as in optical, electronics, and nuclear facilities. Cleanrooms are characterized by a special emphasis on the prevention of particulate generation and the removal thereof prior to deposition on cleanroom surfaces and products to avoid reentry into the air at a later time. A classification system is often observed in the wiper market which categorizes the controlled environment according to the efficiency with which particulates are removed from the air.

Wipers for use in the cleanest classification of cleanrooms typically have a knitted construction, as opposed to a woven or non-woven construction. The knit construction is preferred because, unlike woven or non-woven materials, knitted material is produced by knitting a continuous filament or yarn, thereby resulting in a finished product with fewer loose ends or short fibers. Woven and non-woven materials can be comprised of hundreds or thousands of fibers, portions of which can be released from the material to become particulate contamination in cleanroom environments.

The cost of a knitted product depends to an extent on the method used to make the finished product. Articles which are knitted individually tend to be more expensive than those cut from a large section of knitted material. However, problems exist when articles are cut from a large section of knitted material. By partitioning a continuous knitted sheet, filaments or yarns of the sheet are severed, leaving many loose ends extending from edges of each partitioned section, which then require some type of edge sealing or preparation procedure to prevent the ends from disassociating. Known methods of edge preparation include melting the loose ends with a heating element, cutting the large sheet with a hot wire, laser or ultrasound machine, which simultaneously cuts and seals the ends. Wipers used in the cleanest classification of cleanrooms require a final step of laundering the wipers prior to packaging to dislodge and remove any loose particles or fibers.

A wiper disclosed in U.S. Pat. No. 5,229,181 typifies the labor intensive processes associated with manufacturing methods known in the art. This wiper is produced by a circular knitting machine which knits a continuous cylinder of material. Once the cylinder is removed from the machine, it is ultrasonically point bonded to create a flat two-ply tube which is then cut and sealed perpendicularly across its longitudinal tube axis into individual, tubular wipers of specified lengths. The sealing operation prevents disassociation and fraying of loose fiber ends.

A manufacturing method used to make anoth John C. Hilton closed in U.S. Pat. No. 4,888,229. The wipers are produced by first knitting a sheet of indeterminate dimensions. A pattern is impressed upon the sheet of material by fusing together the fibers in the knit, with the pattern corresponding to the future borders of individual wipers. Once the pattern is formed, the sheet of material is separated into individual wipers by cutting along the pre-formed borders. Alternatively, a heated knife or wire may be used to simultaneously cut the knit fibers and seal the edges. A final wash cycle is required to dislodge any loose fibers prior to packaging.

The industry needs a more effective manufacturing method which requires fewer processes and less equipment to produce individual wipers. The present invention is drawn toward such an article of manufacture and a method for producing the same.

DISCLOSURE OF THE INVENTION

It is an object of the present invention to knit a wiper to a desired size.

It is a another object of the present invention to manufacture a wiper having no edge-sealing requirements after the wiper is knitted.

It is yet another object of the present invention to manufacture a knitted web of material to length which has selvaged side edges.

According to the present invention, a knitted web includes a first wiper and a second wiper knitted from a continuous strand of a primary yarn and a continuous strand of a reinforcing yarn, each of the first and second wipers defined peripherally by opposed, outside, selvaged side edges and finished leading and trailing edges, and a separator portion knitted between said finished trailing edge of said first wiper and said finished leading edge of said second wiper using a dissociable yarn. A plurality of wipers is created by cutting the continuous strands of yarn extending between the first and second wipers and removing the dissolvable portion.

One feature of the present invention is the knitting method which creates wipers with selvaged side edges that require no treatment after being knit to prevent raveling.

Another feature of the present invention is the knitting method which creates wipers with finished leading and trailing edges that require no treatment after being knit to prevent raveling.

Still another feature of the present invention is the dissociable yarn which, when removed, leaves the wipers separated and in a finished state.

Yet another feature of the present invention is the knitting method which reduces the number of manufacturing steps required to create a plurality of wipers.

These and other objects, features and advantages of the present invention will become more apparent in the light of the following detailed description of best mode embodiments thereof as illustrated in the accompanying drawings.

BRIEF DESCRIPTION OF THE DRAWINGS

FIG. 15 is an enlarged end view of high and low butt needles of the knitting machine of. FIG. 4;

FIG. 17 illustrates stitches which result from movement of the cams shown in FIG. 16.

BEST MODE FOR CARRYING OUT THE INVENTION

Figure 1:
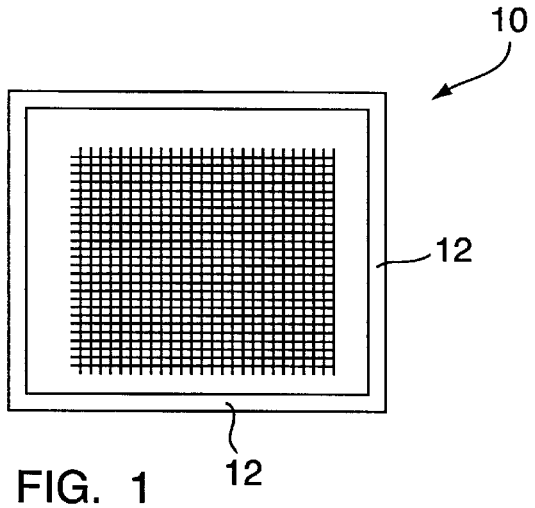
FIG. 1 PRIOR ART
FIG. 1 is an elevated schematic view of a first prior art wiper.

Referring to FIG. 1, one known wiper 10 in the prior art is manufactured by a knitting machine which knits a large tube of material. The tube is then scoured in a pressurized vessel to remove knitting oils and passed through a cutting machine which cuts the tub longitudinally into a single-ply sheet. The single sheet is then cut into individual wipers according to a desired shape and size, each of which is provided with a fused border along peripheral edges of the wiper and extending inwardly into the wiper a distance great enough to provide the material with sufficient integrity. Alternatively, wipers are cut and their edges sealed simultaneously by a known device such as a hot wire, laser, or ultrasound machine.

A problem associated with the wiper 10 is the abrasiveness which results from the edge sealing process. The methods currently used to seal the edges tends to produce a stiff, coarse portion on the wiper due to the melting process, which in turn can scratch surfaces, impede wiper performance, and decrease the adsorption capability of the wipers. Additionally, if the sealing device malfunctions, there is the possibility that many loose yarn ends become a source of contamination.

Figure 2:
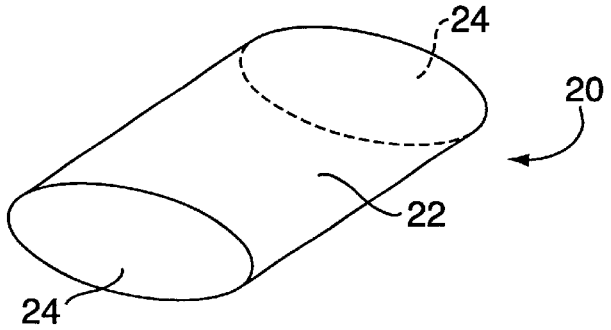
FIG. 2 PRIOR ART
FIG. 2 is a perspective view of a second prior art wiper.
Figure 3:
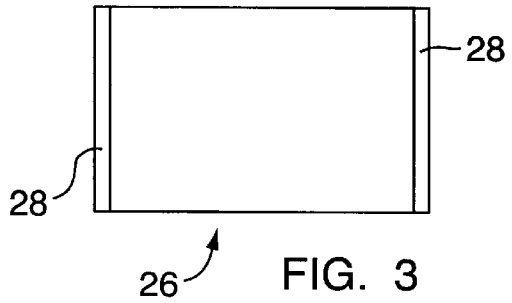
FIG. 3 PRIOR ART
FIG. 3 is an elevated schematic view of the prior art wiper of FIG. 2 shown with sealed ends.

Referring to FIGS. 2 and 3, another prior art wiper 20 is manufactured by a knitting machine which generates a continuous tube of material. Individual wipers are then produced by cutting the continuous tube into individual tubes 22 of a specified length having open ends 24. Double-ply wipers 26 are then created from each tube 22 by flattening the tube 22, point bonding the two plies, and sealing the open ends 24 to form closed ends 28. This wiper also presents the functional concerns discussed above that exist when the edges are sealed, however there are two fewer edges that require sealing.

Figure 4:
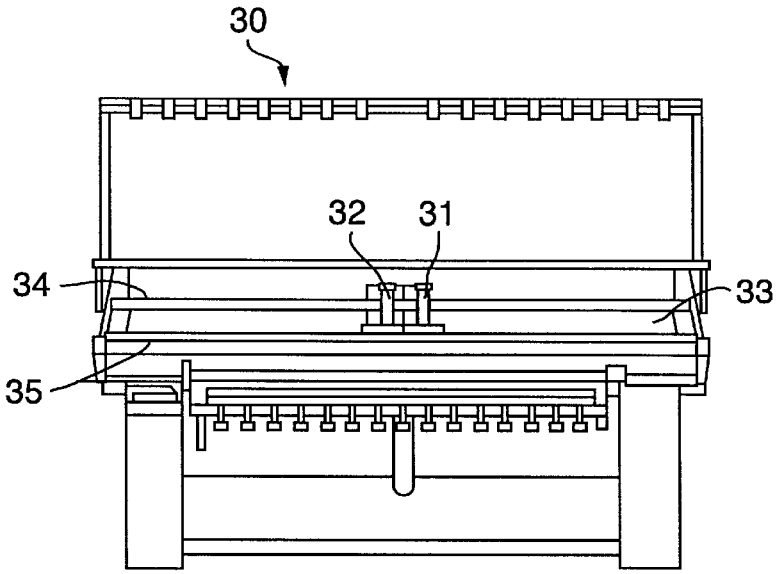
FIG. 4 is a front view of a knitting machine used in producing wipers according to the present invention.
Figure 5:
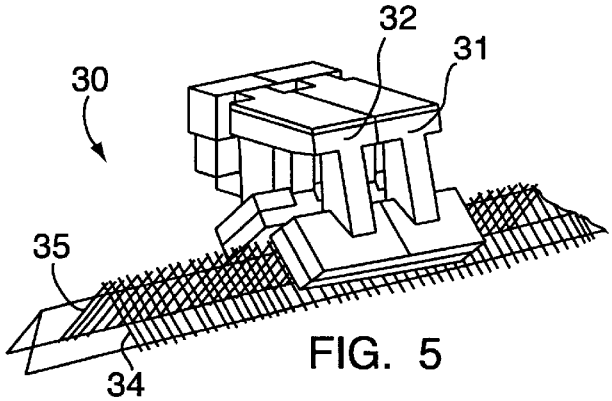
FIG. 5 is an enlarged perspective view of knitting heads and needle beds of the knitting machine shown in FIG. 4.

Referring to FIGS. 4 and 5, a knitting machine 30 used in knitting wipers according to the present invention has a double cam design which permits two knitting passes, or courses, to be knitted simultaneously. The knitting machine 30 has first and second knitting heads 31, 32 which traverse across a needle bed 33. The needle bed 33 has parallel front and back rows of needles 34, 35. The knitting heads 31, 32 are mechanically linked to each other so that both knitting heads always travel across the needle beds simultaneously.

Figure 5A:
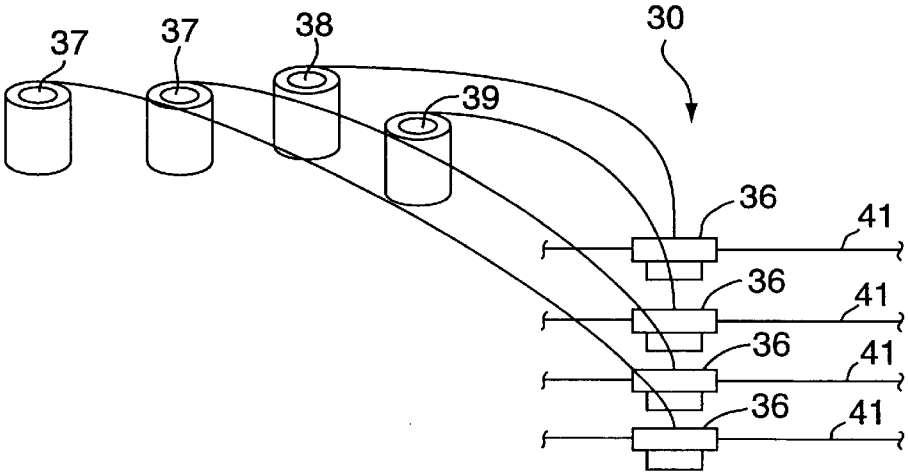
FIG. 5A is an enlarged perspective view of carriers and spools of yarn of the knitting machine shown in FIG. 4.

Referring to FIG. 5A, each of four yarn carriers 36 is attached to, and is slidable along, its own suspension wire 41 on the knitting machine 30 for feeding yarn to the knitting heads 31, 32. The knitting heads 31, 32 are programmed to engage specific carriers 36 during the knitting process in order to knit with the yarn associated with the engaged carrier 36. Each knitting head 31, 32 is capable of traversing the needle bed with any of the four carriers 36. The four carriers 36 are equipped with four spools of yarn: two carriers with a primary yarn 37, one carrier with a reinforcing yarn 38, and one carrier with a dissociable yarn 39.

In the best mode embodiment, the primary yarns 37 are made from conventional polyester, the reinforcing yarn 38 is elastic yarn, and the dissociable yarn 39 is a water soluble PVA yarn.

The three types of yarn are all of a filament-type as opposed to a spun-type yarn. Filament yarn is formed by bundling together continuous filaments of material with or without twist, and spun yarn consists of staple fibers bound together by a twist. Both types of yarn are given denier values which equal the weight, measured in grams, of nine thousand (9000) meters of the yarn. When the denier value is less than the number of filaments in the yarn, the yarn is considered to have a microdenier value. Denier value is also changed by varying the size of the filaments in the yarn.

Figure 6:
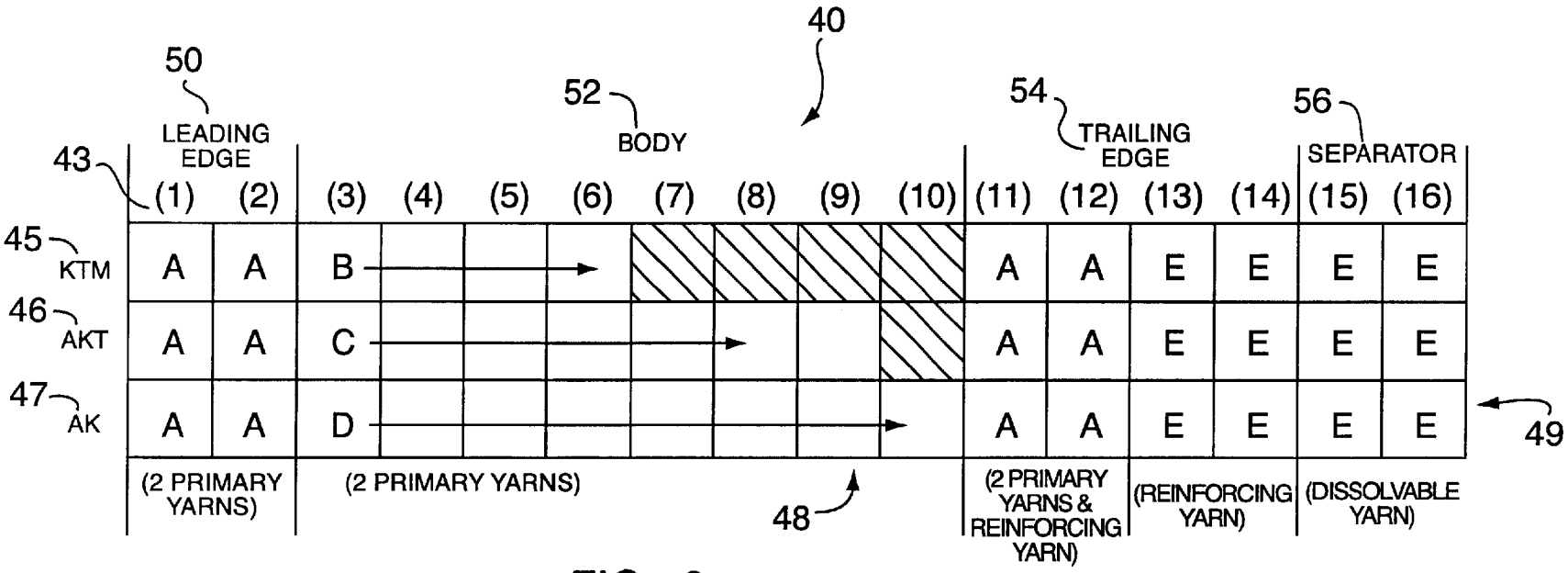
FIG. 6 illustrates stitch types and number of carrier courses made by the knitting machine of FIG. 4 to produce leading edge, trailing edge, body and separator portions of one of three configurations of wipers.

Referring to FIG. 6, a table 40 is shown representing courses 43 of the knitting heads 31, 32 across the needle bed 33 to produce three different configurations of wipers: a Knit-Tuck-Miss wiper 45 (hereinafter "KTM wiper"); an All Knit, Tube wiper 46 (hereinafter "AKT wiper"); and an All Knit wiper 47 (hereinafter "AK wiper"). Additionally, table 40 has been divided to correspond to wiper portions, described below, which are knitted into each wiper configuration 45, 46, 47.

The wiper portions, which are numbered in parentheses, include a leading edge 50 knitted with courses designated (1) and (2), a wiper body portion 52 knitted with courses (3) through (10), and a trailing edge 54 knitted with courses (11)–(14). The body portion 52 of each of the three wiper configurations has a different number of knitted courses. For instance, the body portion 52 is knitted with courses (3) through (8) for the AKT wiper 46, courses (3) through (10) for the AK wiper 47, and courses (3)–(6) for the KIM wiper 45. The separator portion 56 is knitted between each wiper with courses (15)–(16).

The table also indicates stitch types A–E which are used to produce the different wiper portions and the separator portion 56. For example, the leading edge 50 of all three wiper configurations 45–47 is knitted using a stitch designated by the letter A. Again, the stitch used in knitting the body 52 of the wipers depends on the type of wiper being knitted: the KTM wiper body portion 52 is knitted with a B stitch, the body portion 52 of the AKT wiper 46 is knitted with a C stitch, and the body portion 52 of the AK wiper 47 is knitted with a D stitch. The trailing edge 54 for each wiper is knitted using two courses (11)–(12) of the A stitch and two courses (13)–(14) of the E stitch. The separator portion 56 of each wiper is also knitted with the E stitch.

The yarns used in knitting each of the wiper portions are given in parentheses at the bottom of the table. The leading edge and body portions 50, 52 for all wipers are knitted using two primary yarns 37. The trailing edge 54 is knitted with the two primary yarns 37 and the reinforcing yarn 38 using a process described in detail later. The separator portion 56 is knitted with the dissolvable PVA yarn 39.

Figure 7:
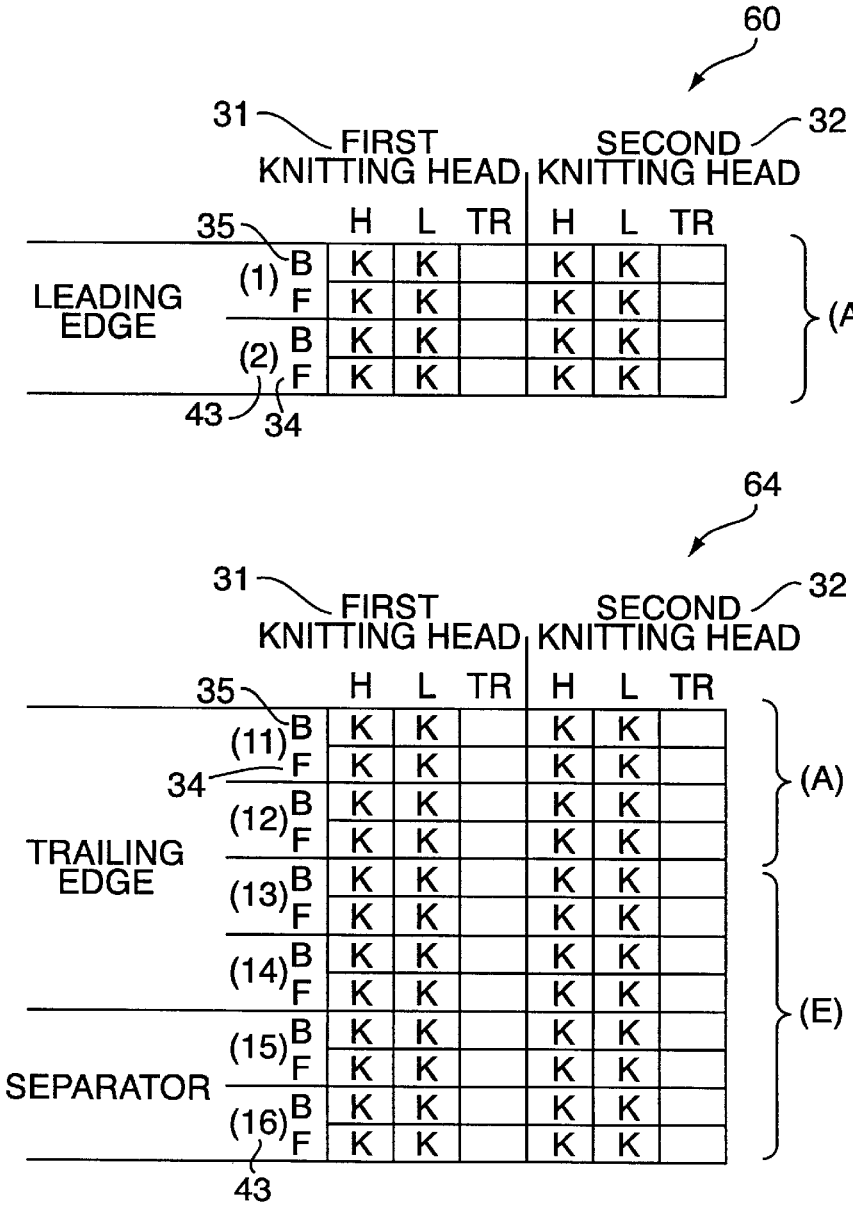
FIG. 7 illustrates a knitting machine needle program for knitting the leading edge, trailing edge, and separator portions for the three wiper configurations tabulated in FIG. 6.
Figure 8:
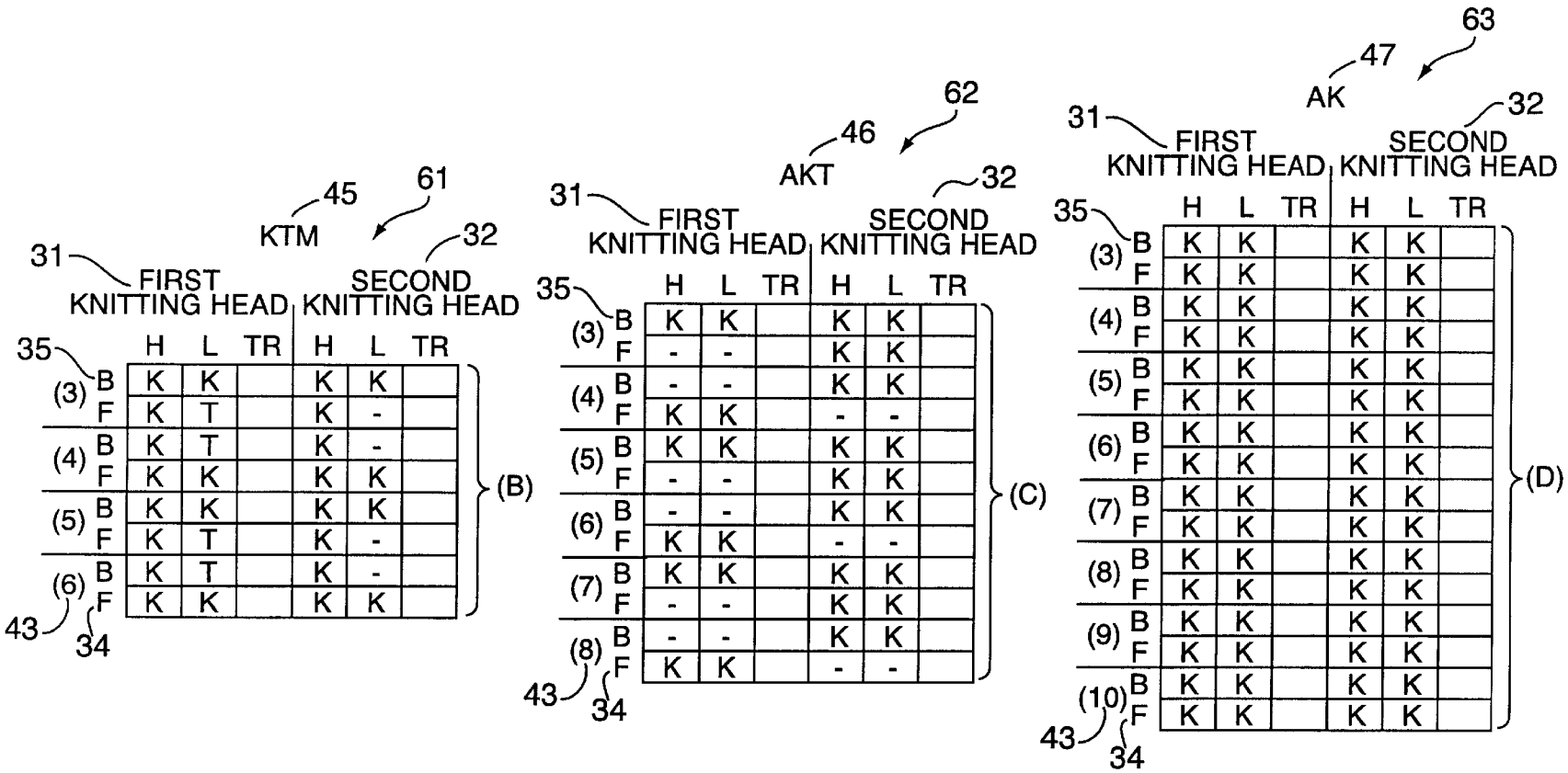
FIG. 8 illustrates a knitting machine needle program for knitting the body portion for the three wiper configurations tabulated in FIG. 6.

Referring to FIG. 7–8, tables 60–64 provide details of the various stitches discussed in FIG. 6. Each of the tables 60–64 includes the stitch letter in parentheses which correspond to stitch letters provided in the boxes of FIG. 6. For instance, courses (1) and (2) in Table 60 and courses (11) and (12) of Table 64 use the (A) stitch, and courses (13)–(16) in Table 64 use stitch (E). Table 60 is organized to indicate the stitch used by the first and second knitting heads 31, 32 to knit the leading edge 50, or courses (1) and (2). Each course 43 has information regarding the front and back rows 34, 35 of needles, which are designated by lowercase letters "b" and "f", respectively, throughout tables 60–64. The first and second knitting heads 31, 32 each have three vertical columns designated with an H, L, or TR, to provide details of stitch programs for the front and back rows of needles 34, 35. The H corresponds to high-butt needles, the L indicates low-butt needles, and the TR indicates stitch transfer, where a yarn can be transferred from the front 34 to the back row 35 of needles, or vise-versa. Note that none of the wipers in tables 60–64 use the transfer function, as is indicated with blank boxes in the TR column of tables 60–64. Each of the boxes in the H and L columns indicates whether a Knit (K), tuck (T), or Miss (–) stitch is programmed for that specific course.

Stitches (A) and (E) produce finished leading and trailing edges that require no treatment after knitting is complete. Knitting the leading edge requires no elastic or reinforcing yarn because the nature of the knitted loops produced in the knitting procedure self-close in the wiper leading edge due to the direction of knitting. On the other hand, the trailing edge requires the use of elastic or reinforcing yarn to ensure the last course does not separate from the previously knitted-course.

Tables 61–63 indicate details of stitch protocols used to knit the body 35 portions 52 of each of the wiper configurations 45–47. The course designations 43 given in each of the tables 61–63 begin with (3) because the leading edge 50 of all wiper configurations 45–47 is knitted with courses (1) and (2). As seen in table 62, knitting course (5) of wiper 46 with stitch (C) accords with the following needle program:

1. High and low butt needles H, L on the back bed 35 of the first knitting head 32 do a knit stitch (K), while high and low butt needles H, L on the front bed 34 of the first knitting head 32 do a miss stitch "–".
2. All needles H, L on the front and back beds 34, 35 of the second knitting head 33 do a knit stitch (K).

Likewise, course (6) of wiper 45 of table 61 is knitted with stitch (B) according to the following needle program:

1. High butt needles H on the front and back beds 34, 35 of the first and second knitting heads 31, 32 do a knit stitch (K).
2. Low butt needles L on the front bed 34 of the first knitting head 32 do a knit stitch (K).
3. Low butt needles L on the back bed 35 of the first knitting head 32 do a tuck stitch (T).
4. Low butt needles L on the back bed 35 of the second knitting head 33 do a miss stitch "–".
5. Low butt needles L on the front bed 34 of the second knitting head 33 do a knit stitch (K).

Figure 9:
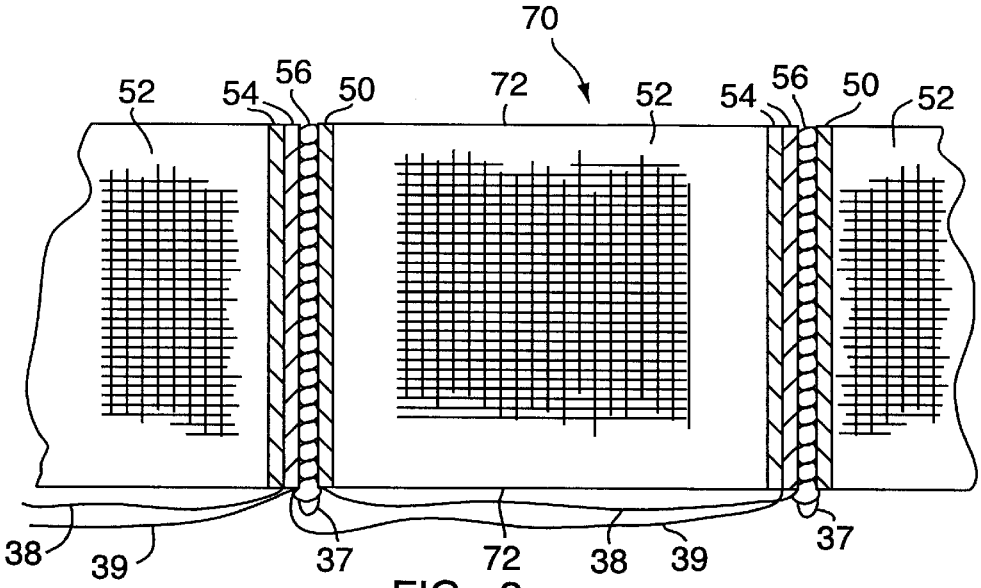
FIG. 9 is an schematic view of a continuously-knitted web of material divided into wipers having the wiper portions tabulated in FIG. 6.

Referring to FIGS. 9, a continuous web of material 70 is shown after it is removed from the knitting machine. The web 70 includes parallel side edges 72, as well as the wiper portions discussed above. Due to the crossover technique used by the knitting heads and described in detail later, the side edges 72 are selvaged and require no treatment to prevent raveling. An important feature of the present invention is the ability to produce a wiper of a desired length and width, within the capabilities of the knitting machine. Wiper width is varied by physically changing the number of needles in the needle bed 33 and changing the machine program to function with the number of needles in the knitting operation. The length of each wiper can also be varied by changing the number of courses that are programmed to be knitted into the body portion 52 of the wiper.

The knitting machine knits the wipers and separator portions consecutively without cutting any of the yarns used in the knitting process. The same three yarns are used from one wiper to the next. The knitting machine accomplishes this by carrying yarns along the web 70 when the yarns are not being used in a knitting operation. For example, the dissociable yarn 39 used to knit the separator portion 56 between each wiper is carried along the side of the web until it is to be used in knitting another separator portion 56. Therefore, in order to separate the wipers from each other, the loose yarns extending between wipers need to be cut. The loose yarns include one strand of dissociable yarn 39, one strand of reinforcing yarn 38, and two strands of primary yarn 37. In the best mode embodiment, the loose yarns are cut manually before the separator portions 56 are removed from the web.

Figure 10:
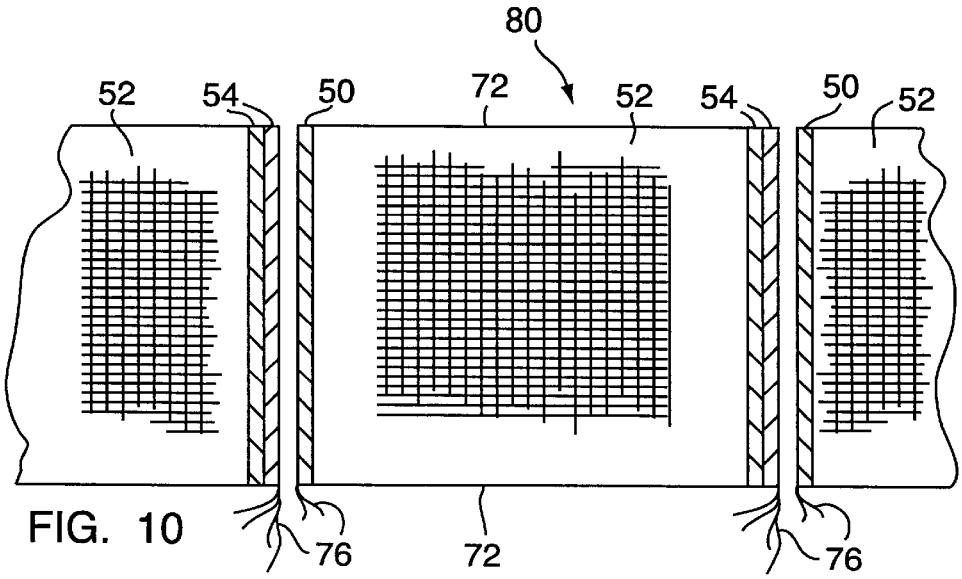
FIG. 10 is an enlarged, highly schematic view of the web of material shown in FIG. 9 after separator portions have been removed.

Referring to FIG. 10, individual wipers 80 are shown after the separator portions 56 are removed. Additionally, the loose ends 76 hang from each wiper after yarns are severed. The leading edge 50 contains two loose ends of the two primary yarns used to knit wiper portions 50, 52, and 54. The trailing edge has four loose ends: two ends from the two primary yarns 37, and both ends of the one reinforcing yarn 38.

Figure 11:
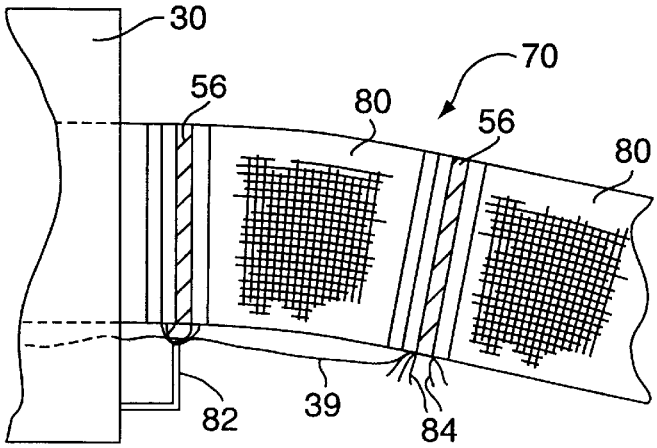
FIG. 11 is a schematic elevation view of the knitting machine of FIG. 4 shown with a cutter severing loose yarns in the web of material shown in FIG. 9.

Referring to FIG. 11, the continuous web 70 is shown as it is knitted by the knitting machine 30. A cutter 82 severs loose fibers as the web 70 is knitted, leaving loose ends 84. A strand of dissociable yarn 39 is shown hanging alongside of wiper 80 prior to being dissolved.

Figure 12:
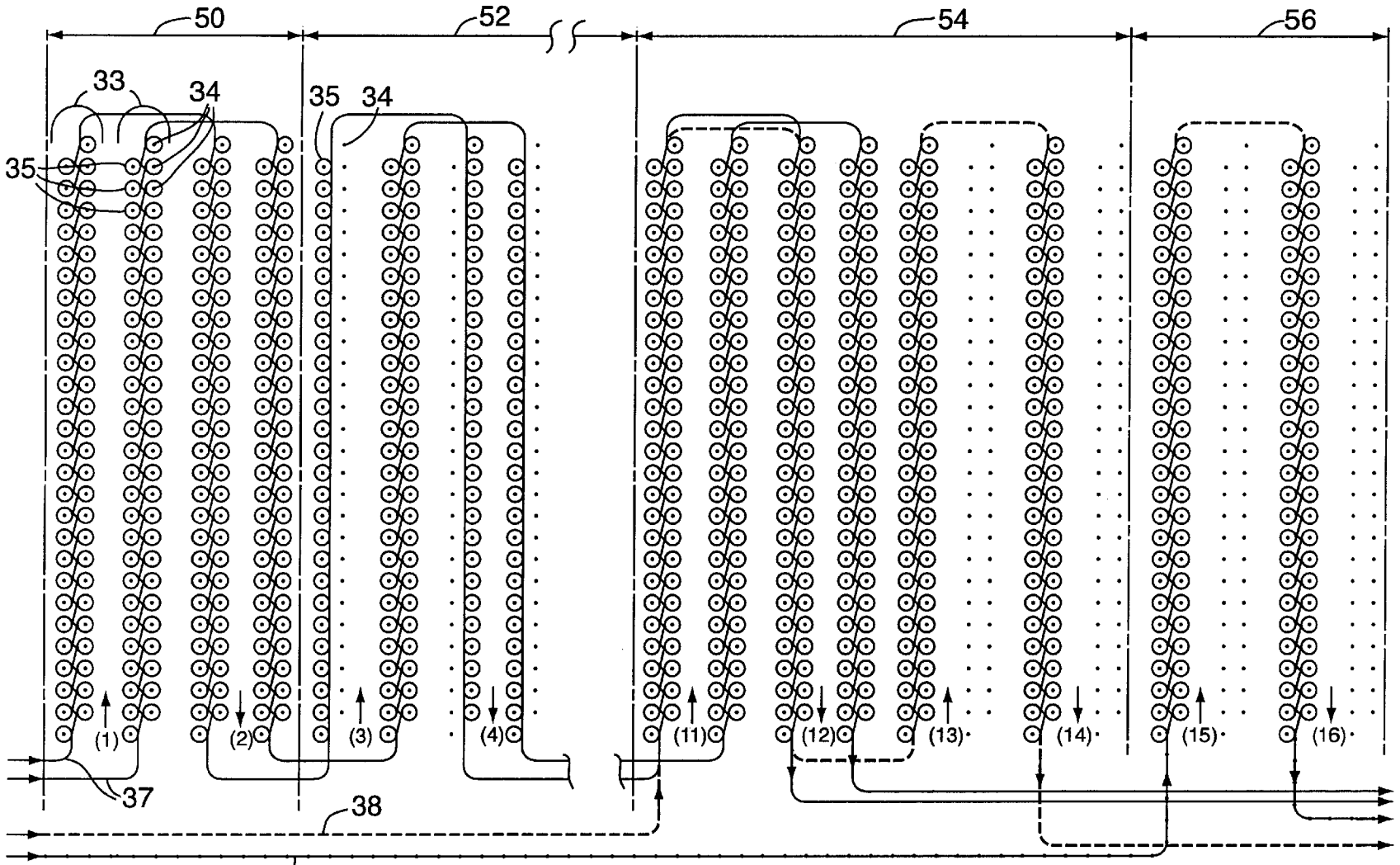
FIG. 12 is a highly schematic view of a knitting process used by the knitting machine of FIG. 4 to knit wipers.

Referring to FIG. 12, a schematic representation of a knitting procedure is illustrated for creating the AK wiper 47. The first and second knitting heads 31, 32 initially traverse along the needle bed 33 designated by the number (1). In actuality, each of the knitting heads 31, 32 moves along the same needle bed 33, but for demonstrative purposes each knitting head 31, 32 has been illustrated as traversing its own needle bed 33. As the knitting heads 31, 32 traverse the needle bed 33, the front and back rows of needles 34, 35 rise according to a known knitting protocol which is programmed into the knitting machine prior to operation.

Courses (1) and (2) define the knitting steps for the leading edge 50 of wiper 47 and correspond to stitch A defined in FIG. 7. Courses (3) and (4) define the first two courses for the body 52 of wiper 47 and correspond to stitch D defined in FIG. 7. For the remaining wiper configurations, 45, 46, stitches used in knitting courses (3) and (4) can be determined upon reference to FIGS. 6–8. The trailing edge 54 is knitted in courses (11)–(14), the primary yarns 37 being used to knit courses (11)–(12) and dropped for courses (13) and (14), and the reinforcing yarn 38 being used by the first knitting head 32 to knit courses (13) and (14). The separator portion 56 is knitted in courses (15) and (16) by the first knitting head which carries only the dissociable yarn 39 while the second knitting head carries no yarn. After courses (15) and (16), knitting of the wiper is completed, and the entire process is reiterated beginning with pass (1) until a desired number of wipers is knitted.

The dissociable yarn 39 and reinforcing yarn 38 are left hanging alongside the web of material until these yarns are called for in the knitting operation, such as in courses (11) and (15). Likewise, the primary yarns 37 are left hanging after they are released by the knitting heads after pass (12), and they will not be used until the next wiper is to be knitted, at which time pass (1) will be repeated.

Figure 13:
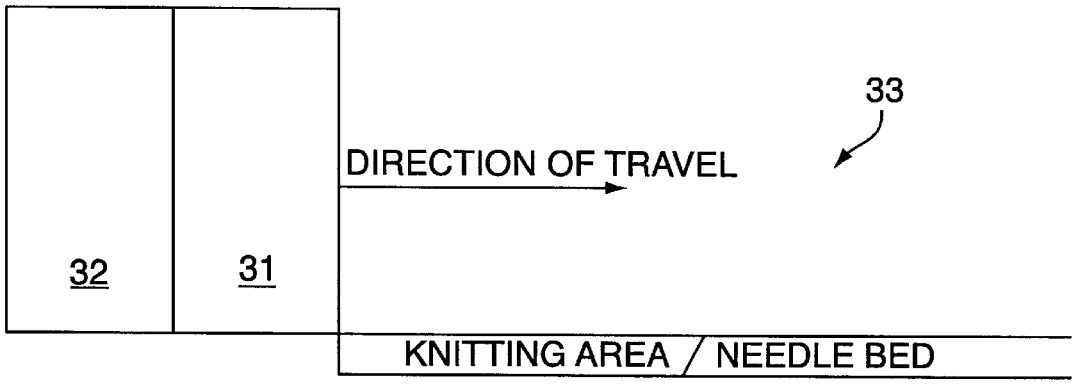
FIG. 13 is a schematic view of first and second knitting head of the knitting machine of FIG. 4 shown traversing the needle beds.
Figure 14:
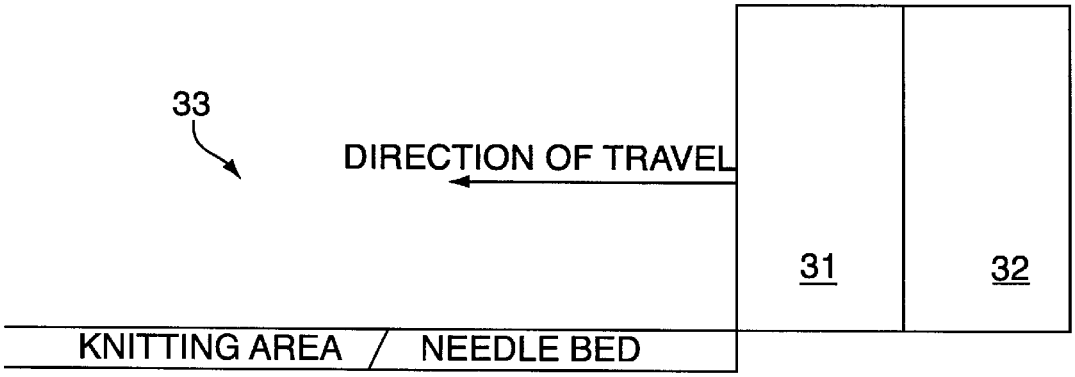
FIG. 14 is a schematic view of the first and second knitting heads shown traveling in a direction opposite to that shown in FIG. 13.

Referring to FIGS. 13 and 14, the knitting heads 31, 32 traverse the needle bed 33 as a linked pair to produce wiper side edges that require no treatment to prevent raveling. The first knitting head 31 is designated as the knitting head which first crosses the needle beds, regardless of the direction of travel. When the knitting heads reach the end of a course, the yarns carried by each head are swapped so that the first yarn brought across the bed remains first when the knitting heads 31, 32 return. This process results in selvaged side edges that require no anti-raveling treatment.

Figure 15:
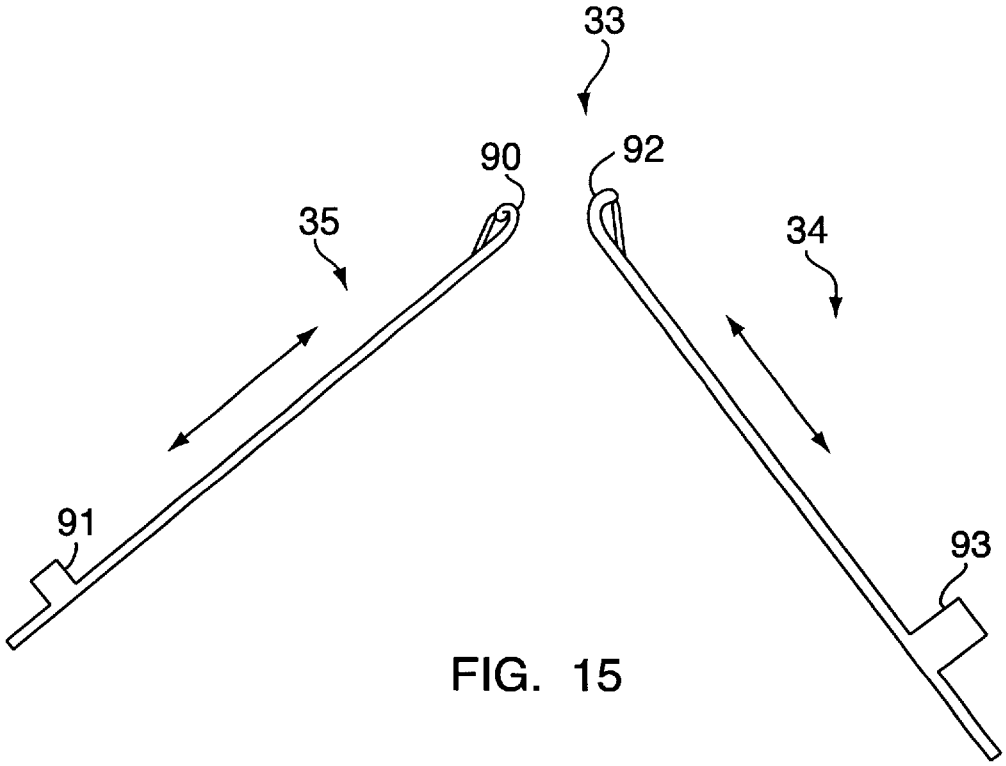

Referring to FIG. 15, the needle bed 33 includes low butt needles 86 having short butts 87 and high butt needles 88 having long butts 89. The individual needles 86, 88 move up and down in the needle bed 33 according to programmed needle movements for knitting each of the wiper configurations. The butt height 87, 89 determines whether or not the needle will be actuated by a passing knitting head during each of the knitting courses described above.

Figure 16:
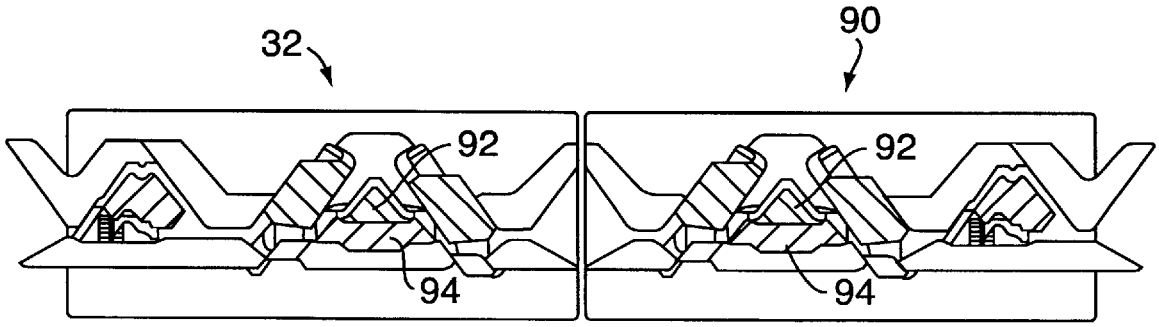
FIG. 16 is a schematic elevation view of a cam arrangement in a knitting head of the knitting machine of FIG. 4.

Referring to FIGS. 16 and 17, each of the knitting heads 31, 32 includes two cam arrangements 90, each of which passes in a parallel orientation over a row of needles 34, 35. Each cam arrangement 90 includes a center cam 92 and a needle cam 94 which are moved to actuate certain needles in the needle bed 33. Depending on the desired stitch, the cams 92, 94 are moved individually or together according to the configurations shown in table 95. As seen in table 95, cams 92, 94 can be fully extended, extended halfway, or not extended at all, and each cam movement, or lack thereof, effects needle actuation. For instance, when the center cam 92 is extended halfway and the needle raising cam 94 is fully extended, as seen in the box designated by the numeral 96, the high butt needles 88 do a knit stitch (K) and the low butt needles 86 do a tuck stitch (T).

Figure 18:
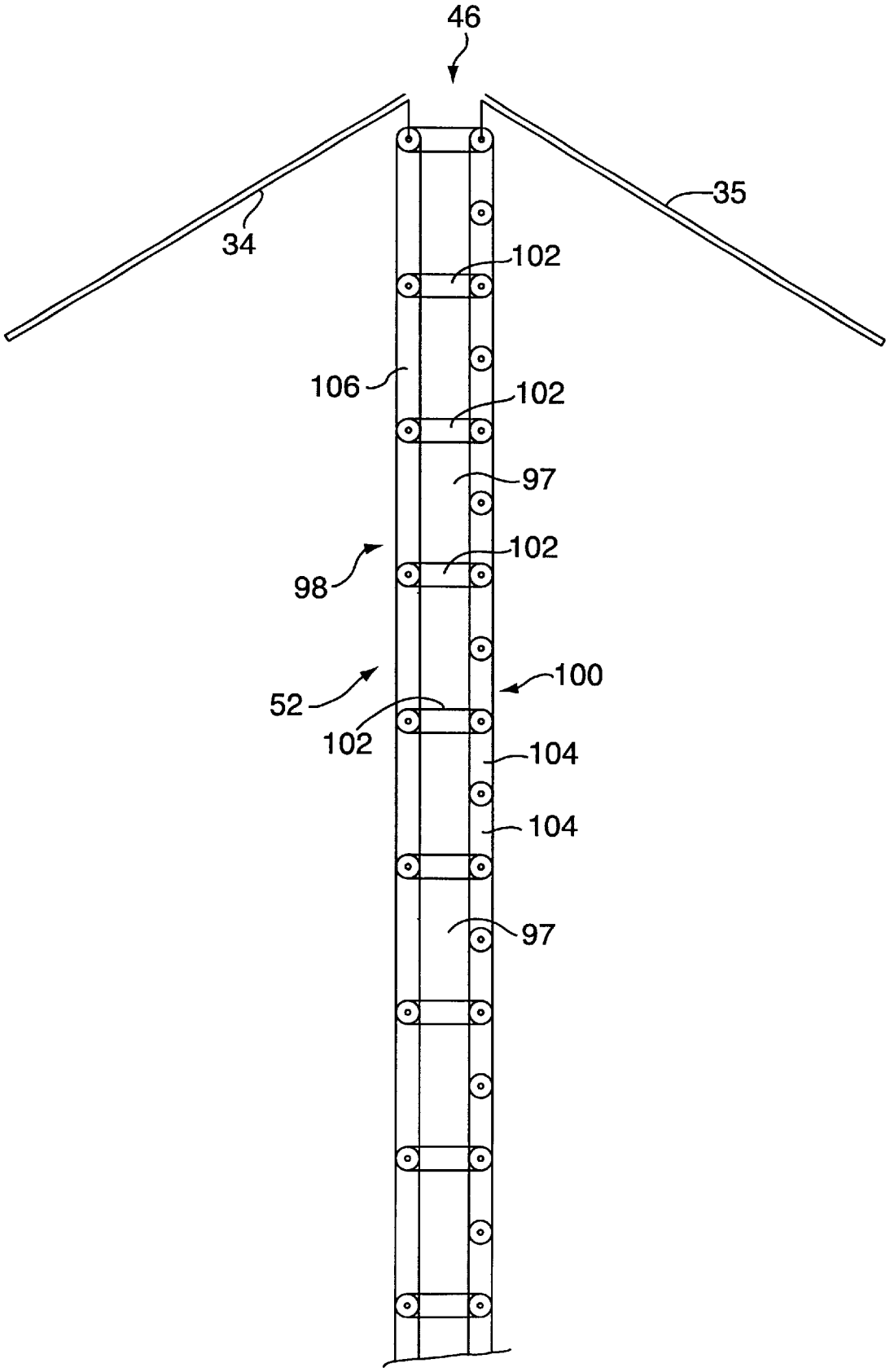
FIG. 18 is a schematic side view of the knitting bed and knitting heads shown in FIG. 5 taken along the lines 18—18.

Referring to FIG. 18, the body portion 52 of the AKT wiper 46 is knitted by creating a series of stacked tubular sections 97. Each tube includes a front side 98 knitted by the front row of needles 34 and a back side 100 knitted by the back row of needles 35. A series of connectors 102 attach the front and back sides 98, 100, and serve to provide upper and lower closures for each tubular section. The back side 100 is defined by two courses 104 of knitting, and the front side 98 is defined by a single course 106 of knitting. Specifics of the AKT stitch can be referenced in table 62.

According to the best mode embodiment, a knitting machine suitable for manufacturing the wipers described herein is model SFF-152T 12-gauge V-bed knitting machine manufactured by Shima Seiki of Japan. This machine is equipped with seven hundred and twenty (720) needles in each of the front and back needle rows 34, 35, and a takedown mechanism which is a standard industry feature that applies tension to the fabric as knitting progresses. A wiper with an approximate width of seven inches is produced by using one hundred and forty nine needles in each of the front and back needle rows. Additionally, to knit the AK and AKT wipers, only high butt needles are installed in the machine, while the KTM wiper is knit by alternating high and low butt needles in the front and back rows of needles.

Once the needles are installed, the knitting machine is programmed according to tables 40 and 60–64 to activate the center and needle raising cams at specific times during the knitting process. The program is entered using a 3.5 inch disk drive or by directly entering information using a keyboard on the machine. The program for a specific wiper configuration determines the timing and height to which needles will raise, or activate, to create knit, tuck, or miss stitches.

The actual process of knitting an AK wiper is begun by knitting a separator portion 56. This first step allows the first wiper to have a finished front edge when the knitted material is removed from the knitting machine and subsequently laundered to separate the individual wipers. The separator portion 56 is knitted using only the dissociable yarn 39 with the machine in single-cam mode, i.e., using only the first knitting head 31. After two courses of the first knitting head 31, the dissociable yarn 39 is released by the knitting head.

Knitting of the actual wiper is then begun by knitting the leading edge 54 of the wiper with courses (1) and (2). The smallest loop size is used to produce a strong wiper edge and each knitting head 31, 32 carries a primary yarn 37. The body 52 is knitted next using a large loop size according to courses described in FIG. 7. Once the programmed number of passes is completed for the wiper body 52, i.e., the four courses used in knitting a KTM wiper, the first knitting head 31 adds the reinforcing yarn 38 and begins knitting the trailing edge 54 with course (11) using the primary and reinforcing yarns. Two courses are knit using both knitting heads 31, 32. The first head knits with one strand of the primary yarn 37 entangled with one strand of the reinforcing yarn 38, and the second head knits with only one strand of the primary yarn 37. When courses (11)–(12) are complete, the primary yarns 37 are dropped out of the knitting operation and the first knitting head 31 carries only the reinforcing yarn 38 and uses a small loop stitch to form a tightly knitted edge. The second knitting head 32 does no knitting. Another separator portion 56 is knitted to the trailing edge 54 and the machine is then prepared to start knitting another wiper beginning with the leading edge 50.

An AKT wiper 46 is knitted using the same stitches as the AK wiper, with the exception of stitches in the body portion 52. The AKT wiper is designed to have increased adsorption capabilities, and incorporates a stitch which adds bulk to the body of the wiper. The wiper body can be thought of as a group of horizontally stacked tubes knitted one on top of each other, as seen in FIG. 18, with the bottom of the tube being knitted on the front and back beds together, and the sides of each tube then being knitted individually on the front and back needle beds. Finally, each tube is closed off by knitting on both the front and back beds simultaneously, which also serves as the bottom of the next tubular structure.

An important feature of the wiper 46 configuration is that instead of both sides of the tube having an equal number of courses, the back bed is knitted with two courses and the front with one course. This provides more room for fluid along with more fabric stability in the side-to-side direction. Once the wiper body is knitted, construction of the wiper is completed by knitting the body reinforcement, and the trailing edge, followed by another separator portion which transitions to the leading edge of the subsequent wiper.

A KTM wiper 45 is also made using the same steps as the AK wiper, with the exception of a unique construction used to knit the wiper body. The significant difference between the KTM wiper and the other wiper configurations rests in the needle selection and programming of the knitting machine. The name "KTM" originates from the knitting process used in constructing the wiper: Knit-Tuck-Miss, where certain needles are selected to do knit, tuck, and miss stitches.

The KTM wiper is constructed by first knitting a leading edge 50 in the same manner as with the AK and AKT wipers. Knitting of the KTM body using the knit-tuck-miss stitches is then begun by making a course with both knitting heads 31, 32 programmed for a knit configuration and the front and back needle beds 34, 35 activated. This step is followed by programming the first knitting head front needle bed for a tuck stitch and first knitting head back needle bed for all knit stitches. The second knitting head front needle bed follows with a miss stitch while second knitting head back needle bed does all knit stitches. On the next course, first knitting head does a tuck stitch on the back needle bed and all knit on the front needle bed. The second knitting head follows the first knitting head with a miss stitch on the back needle bed and all knit on the front needle bed. An important aspect of the KTM knitting process is that when either the front or back needle beds is programmed for a tuck or miss stitch, the other needle bed is programmed for all knit stitches.

Once the body portion is completed, knitting the KTM wiper is completed in the same manner as the AK and AKT wipers. That is, the trailing edge 54 is knitted with two carrier courses in duel cam mode with the first knitting head 31 carrying the reinforcing yarn 38 and a primary yarn 37, and the second knitting head 32 carrying just a primary yarn 37. Two courses are then knitted with a single knitting head carrying just the reinforcing yarn. Another separator portion 56 is then knitted to the KTM wiper and the process of knitting a KTM wiper can begin again.

While preferred embodiments have been shown and described above, various modifications and substitutions may be made without departing from the spirit and scope of the invention. For example, knitting machines having different numbers of cams can be used to produce the wipers described herein. Also, other configurations for the body and leading and trailing edges, including various types of knit patterns, are considered within the scope of the invention to produce wipers of varying shape and texture. Additionally, different types of yarns, including spun yarns, may be used to create wipers having more or less strength, flexibility, and resilience. Use of different types of dissociable yarn is known in the industry and is considered within the scope of the present invention, including yarns dissolved by gases, alcohols, and chemicals. Still further, the high and low butt needles may be organized differently in the needle bed to vary physical characteristics of the knitted fabric. Accordingly, it is to be understood that the present invention has been described by way of example and not by way of limitation.

We claim:

1. A knit wiper comprising:

a finished leading edge extending between two opposed, selvaged side edges and having a width corresponding to a number of knitting needles;

a wiper body knitted to said leading edge and having a length determined by a number of knitting courses;

a wiper body reinforcement knitted to said wiper body; and a finished trailing edge knitted to said wiper body reinforcement.

2. The knit wiper according to claim 1 wherein said leading edge and said wiper body are knit with a continuous strand of a primary yarn and said wiper body reinforcement is knit with said strand of primary yarn and a strand of a reinforcing yarn and said trailing edge is knit with said strand of reinforcing yarn.

3. The knit wiper according to claim 2 wherein said reinforcing yarn is an elastic yarn.

4. The knit wiper according to claim 1 wherein the wiper body has a variable length corresponding to a number of courses knit into the wiper body and said width is varied by changing said number of knitting needles.

5. The knit wiper according to claim 1 wherein said primary yarn is selected from the group consisting of polyester yarn, polypropylene yarn, nylon yarn, lyocell yarn, and rayon yarn.

6. A knitted web, comprising:

a first wiper and a second wiper knitted from a continuous strand of a primary yarn and a continuous strand of a reinforcing yarn, each of said first and second wipers having a wiper body and defined peripherally by opposed, outside, selvaged side edges and finished leading and trailing edges; and a separator portion knitted between said finished trailing edge of said first wiper and said finished leading edge of said second wiper.

7. The knitted web according to claim 6, wherein said wiper body is knitted to the leading edge and a wiper body reinforcement knitted between said wiper body and said trailing edge.

8. The knitted web according to claim 7, wherein each of said leading edges has four knit courses using an edge stitch and each of said wiper body reinforcements has six body reinforcement courses, where the first through fourth body reinforcement courses use a reinforcing stitch and the fifth and sixth body reinforcement courses use said edge stitch and said dissolvable portion has two knit courses using said edge stitch.

9. The knitted web according to claim 6, wherein said reinforcing and primary yarns extend continuously between said first and second wipers.

10. The knitted web according to claim 6 wherein said reinforcing yarn is elastic yarn.

11. The knitted web according to claim 6 wherein said wiper body has a variable length corresponding to a number of courses knit into said wiper body, said wiper body courses being knit with a stitch selected from the group consisting of a KTM stitch, an AKT stitch, and a AK stitch.

12. The knitted web according to claim 6 wherein the separator portion comprises a dissolvable yarn.

13. A method of manufacturing a knitted wiper on a knitting machine, the method comprising;

knitting a first separator portion to a width using a dissociable yarn;

knitting a wiper unit to said separator portion having a width using a primary yarn and a reinforcing yarn, said wiper extending between selvaged side edges and having finished leading and trailing edges;

knitting a second separator portion to said width using said dissociable yarn;

removing said wiper unit and said first and second separator portions as a knitted assembly from said knitting machine;

separeate said first and second separator portions from said wiper unit; and washing said wiper unit.

14. The method of manufacturing a knitted wiper according to claim 13, wherein the step of knitting a wiper unit comprises the steps of:

knitting a leading edge using said primary yarn;

knitting a wiper body to said leading edge using said primary yarn;

knitting a wiper body reinforcement to said wiper body using said primary yarn and said reinforcing yarn; and knitting a trailing edge to said wiper body reinforcement using said reinforcing yarn.

15. The method of manufacturing a knitted wiper according to claim 13, wherein the step of knitting a wiper body reinforcement further includes knitting a first body reinforcement course with said primary yarn together with said reinforcing yarn, knitting a second body reinforcement course with said primary yarn, knitting a third body reinforcement course with said primary yarn together with said reinforcing yarn, knitting a fourth body reinforcement course with said primary yarn, and knitting fifth and sixth body reinforcement courses with said reinforcing yarn, the first four body reinforcement courses being knit using an edge stitch and the fifth and sixth body reinforcement courses being knit with a reinforcement stitch.

16. The method of manufacturing a knitted wiper according to claim 13, wherein the wiper body is knit using a wiper body stitch selected from the group consisting of a KTM stitch, an AKT stitch, and a AK stitch.

17. A method of manufacturing a knitted web, the method comprising the steps of:

(A) knitting a first separator portion to a width using a dissociable yarn;

(B) knitting a wiper unit of said width using a primary yarn and a reinforcing yarn, said wiper being knit to said separator portion and extending between selvaged side edges and having finished leading and trailing edges, said dissociable yarn being kept intact alongside said wiper; and (C) knitting a second separator portion to said trailing edge of said wiper using said dissociable yarn from alongside said wiper, said primary and reinforcing yarns being kept intact alongside said second separator portion;

(D) successively repeating the steps (B) and (C) for a desired number of iterations to produce a knit web having a length comprising separator portions knitted between wipers.

18. The method of manufacturing a knitted web according to claim 17, wherein the step of knitting a wiper unit comprises the steps of:

knitting a leading edge using said primary yarn;

knitting a wiper body to said leading edge using said primary yarn;

knitting a wiper body reinforcement to said wiper body using said primary yarn and said reinforcing yarn; and knitting a trailing edge to said wiper body reinforcement using said reinforcing yarn.

19. The method of manufacturing a knitted web according to claim 17, wherein the step of knitting a wiper body reinforcement further includes knitting a first body reinforcement course with said primary yarn together with said reinforcing yarn, knitting a second body reinforcement course with said primary yarn, knitting a third body reinforcement course with said primary yarn together with said reinforcing yarn, knitting a fourth body reinforcement course with said primary yarn, and knitting fifth and sixth body reinforcement courses with said reinforcing yarn, the first four body reinforcement courses being knit using an edge stitch and the fifth and sixth body reinforcement courses being knit with a reinforcement stitch.

20. The method of manufacturing a knitted web according to claim 17, wherein the wiper body is knit using a wiper body stitch selected from the group consisting of a KTM stitch, an AKT stitch, and a AK stitch.

21. The method of manufacturing a knitted web according to claim 17, wherein the primary yarn is selected from the group consisting of a polyester yarn, polypropylene yarn, nylon yarn, lyocell yarn, and rayon yarn.

22. The method of manufacturing a knitted web according to claim 17, wherein the reinforcing yarn is an elastic yarn.

23. The method of manufacturing a knitted web according to claim 17, further comprising the step of separating the primary and reinforcing yarns extending between wipers and removing the first and second separator portions to create a plurality of knit wipers.

* * * * *

UNITED STATES PATENT AND TRADEMARK OFFICE

CERTIFICATE OF CORRECTION

PATENT NO. : 6,308,538 B1
DATED : October 30, 2001
INVENTOR(S) : William T. Wood et al.

It is certified that error appears in the above-identified patent and that said Letters Patent is hereby corrected as shown below:

Column 2,
Line 3, after "make", please delete "anoth John C. Hilton closed" and insert -- another wiper in the prior art is disclosed -- therefor.

Column 11, claim 13,
Line 8, please delete "separeate" and insert -- separate -- therefor.

Signed and Sealed this

Twelfth Day of March, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,308,538 B1
DATED : October 30, 2001
INVENTOR(S) : William T. Wood et al.

It is certified that error appears in the above-identified patent and that said Letters Patent is hereby corrected as shown below:

Title page,
Item [75], Inventors, after "South", please delete "Egremenont" and insert -- Egremont --.

Signed and Sealed this

Twenty-sixth Day of August, 2003

JAMES E. ROGAN
*Director of the United States Patent and Trademark Office*